US005145086A

United States Patent [19]

Krause

[11] Patent Number: 5,145,086

[45] Date of Patent: Sep. 8, 1992

[54] CAPTIVE TEAR TAB WITH PROTECTIVE MEANS FOR CONTAINER OPENING

[76] Inventor: Arthur A. Krause, 20642 Skouras Dr., Canoga Park, Calif. 91306

[21] Appl. No.: 701,923

[22] Filed: May 17, 1991

[51] Int. Cl.[5] ..... B65D 17/34

[52] U.S. Cl. ..... 220/270; 270/268; 270/269

[58] Field of Search ..... 220/269, 270, 272, 273, 220/276, 268; 215/253

[56] References Cited

U.S. PATENT DOCUMENTS

| | | | |
|---|---|---|---|
| 28,776 | 4/1876 | Cookson . | |
| 3,221,924 | 12/1965 | Harvey et al. | 220/269 X |
| 3,349,949 | 10/1967 | Brown . | |
| 3,411,661 | 11/1968 | Perry . | |
| 3,411,662 | 11/1968 | Silver . | |
| 3,420,398 | 1/1969 | Chun . | |
| 3,432,067 | 3/1969 | Khoury . | |
| 3,442,416 | 5/1969 | Nicholson . | |
| 3,510,022 | 5/1970 | Heller . | |
| 3,610,462 | 10/1971 | Saunders . | |
| 3,696,961 | 10/1972 | Holk, Jr. | 220/269 |
| 3,795,341 | 3/1974 | Ostrem . | |
| 3,819,083 | 6/1974 | Holk . | |
| 3,820,681 | 6/1974 | Huise . | |
| 3,825,149 | 7/1974 | Brown . | |
| 3,837,524 | 9/1974 | Schubert et al. | 220/269 |
| 3,838,788 | 10/1974 | Stargell | 220/276 |
| 3,880,316 | 4/1975 | Martella . | |
| 3,894,653 | 7/1975 | Ostrem . | |
| 3,938,693 | 2/1976 | Patel . | |
| 3,949,898 | 4/1976 | Patel . | |
| 3,977,561 | 8/1976 | Strobe . | |
| 3,980,201 | 9/1976 | Keiji . | |
| 3,986,632 | 10/1976 | Morrison . | |
| 3,994,413 | 11/1976 | Smyth . | |
| 4,017,000 | 4/1977 | Woodley . | |
| 4,018,178 | 4/1977 | Klein . | |
| 4,042,144 | 8/1977 | Henning et al. | 220/273 |
| 4,044,915 | 8/1977 | LaCroce . | |
| 4,055,134 | 10/1977 | Ostream . | |
| 4,116,360 | 9/1978 | McKernan et al. | 220/273 |
| 4,116,361 | 9/1978 | Stargell . | |
| 4,126,244 | 11/1978 | Elser | 220/268 |
| 4,189,060 | 2/1980 | Trotman, III . | |
| 4,325,490 | 4/1982 | Conrad . | |
| 4,356,929 | 11/1982 | Muller-Kuhn . | |
| 4,386,713 | 6/1983 | Baumeyer et al. | 220/269 |
| 4,407,424 | 10/1983 | Heyn . | |
| 4,410,101 | 10/1983 | Vogt . | |
| 4,500,011 | 2/1985 | Brochman . | |
| 4,576,305 | 3/1986 | Saunders | 220/269 |
| 4,759,464 | 7/1988 | Taniuchi . | |
| 4,781,303 | 11/1988 | Wells . | |
| 4,887,732 | 12/1989 | Matsubayashi . | |
| 4,901,877 | 2/1990 | Hall . | |

*Primary Examiner*—Stephen P. Garbe
*Assistant Examiner*—Paul A. Schwarz
*Attorney, Agent, or Firm*—Dennis H. Lambert

[57] ABSTRACT

A tear tab closure for forming an opening in a container end wall, in which the tear tab remains external of the container and captive thereon when it is opened, and further wherein the tear tab is constructed so that there are no recesses for collecting foreign matter. The tear tab is separable from the container end wall along a frangible score line to form the opening, and a pull ring is attached to the tear tab to pull it back from the end wall to form the opening, with the tear tab remaining captive on the container. A vertical fold is formed in the container end wall adjacent the score line to provide a shield to protect the user from the severed edge of the tear tab after it is opened along the score line.

15 Claims, 8 Drawing Sheets

FIG. 1
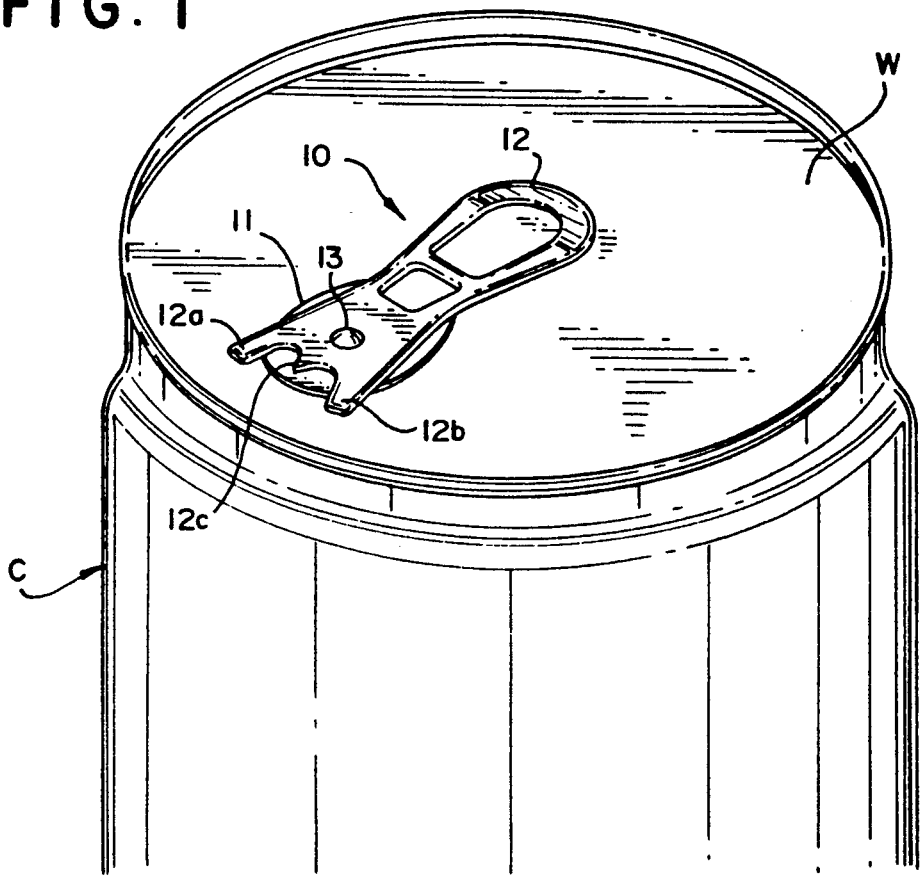
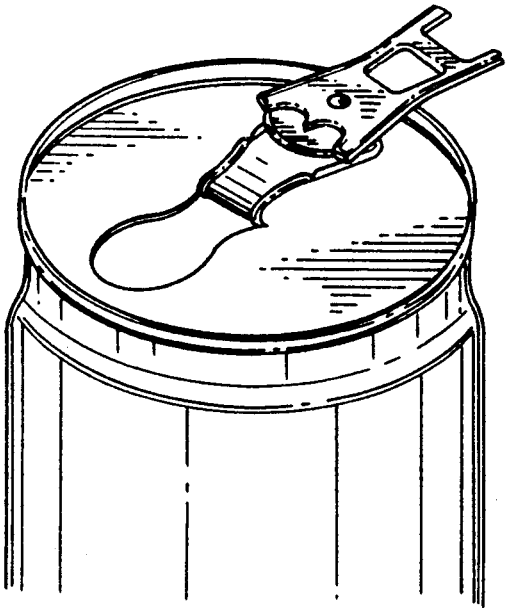
FIG. 2

FIG. 3
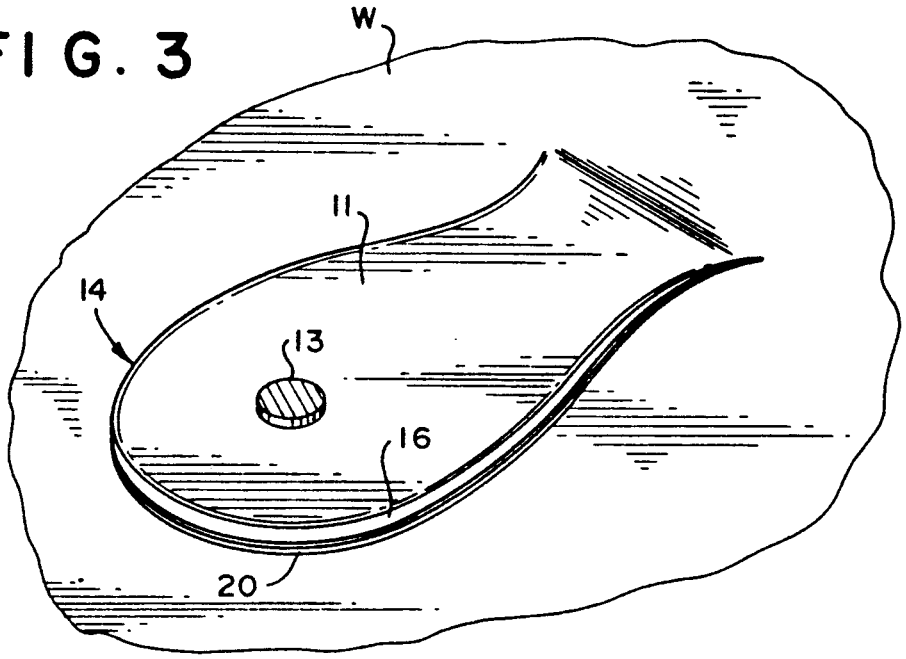
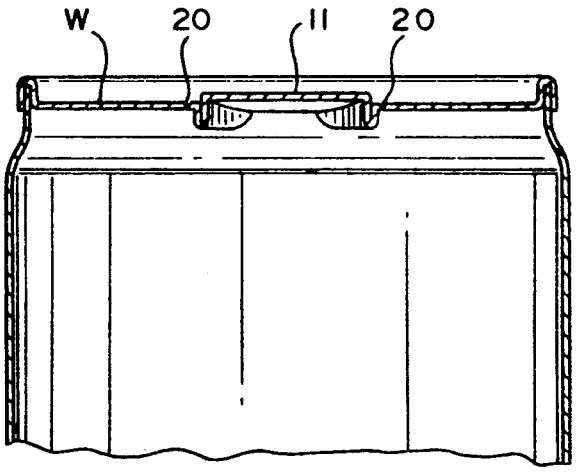
FIG. 4
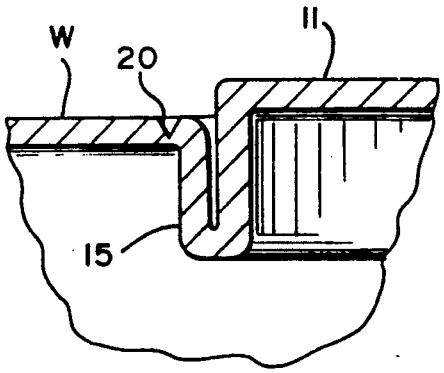
FIG. 5

FIG. 8
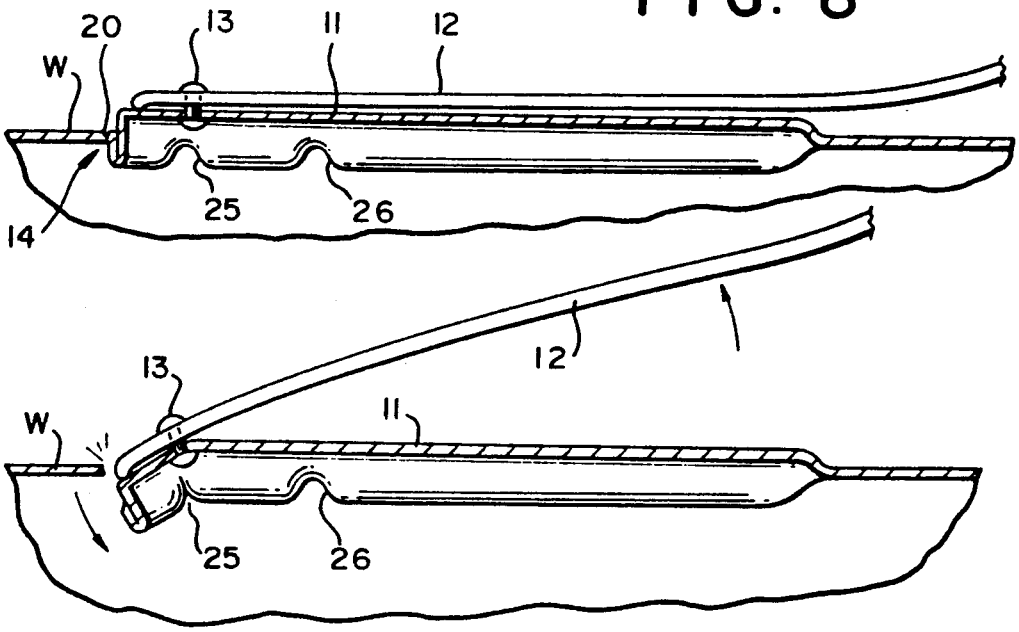
FIG. 9
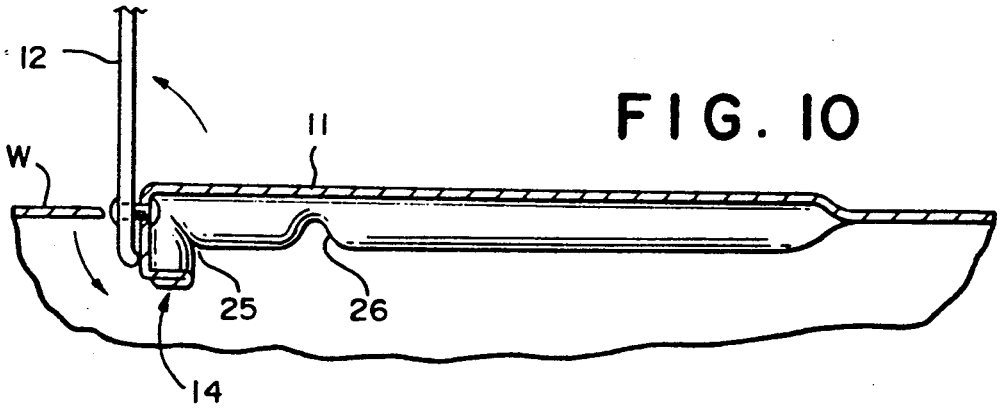
FIG. 10
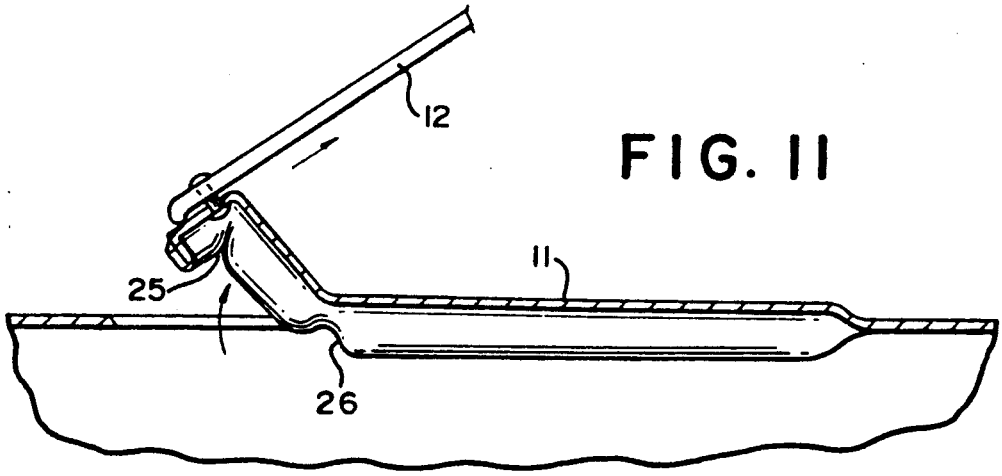
FIG. 11

CAPTIVE TEAR TAB WITH PROTECTIVE MEANS FOR CONTAINER OPENING

FIELD OF THE INVENTION

This invention relates to means for forming an opening in the end of a container, especially a beverage container. More particularly, the invention relates to a tear tab closure that is separable along a score line from the container end to form an opening.

BACKGROUND OF THE INVENTION

The advent of metal and metal alloy containers for beverages, food and other goods led to the development of a variety of means for closing and sealing such containers. Many such closures include permanently affixed container ends which are cut away with separate hand tools. This type of closure is in common use with cans for holding a variety of food products, which are typically stored in a kitchen area and suitable hand tools for opening the container are thus readily accessible.

Beverage containers, on the other hand, have more commonly been developed with convenient, integrally attached tabs that are torn away to form an opening in the container. Many containers of non-carbonated beverages, such as fruit juice and the like, have an opening in an end wall that is closed by a strip of removable tape. This type of closure is not entirely satisfactory, however, because of the less sturdy nature of such closures, and the susceptibility of them to tampering.

Carbonated beverages generally require more secure closures, and have evolved with a variety of so-called "pop-top" or "pull-tab" devices for forming an opening in an end wall of the container. Early devices included removable sections joined to the container end along a frangible score line, and a pull tab or ring attached to the removable section so that it could be pulled from the container end, separating along the score line, to form an opening. The removed section and the attached pull tab or ring were then discarded. This approach was unsatisfactory because of the ecological damage created by the discarded tabs.

To alleviate the environmental harm produced by such removable pull tabs, closures were developed that remained attached to the container after being opened. These closures also comprise a frangible section of the container end wall, joined to the end wall along a score line, and including an actuating ring associated with the frangible section. However, rather than being completely removed from the container end wall and discarded, the frangible section remains attached to or captive on the container. The most commonly used closure of this type is pushed into the container by the actuating ring. While this solves the problem related to environmental damage that was caused by discarded pull tabs, it gives rise to new problems. For instance, the container end wall, including the frangible section, sometimes become contaminated with dirt or other foreign material. Consequently, when the section is displaced into the interior of the container to form an opening, the contents of the container are subject to contamination by the inwardly displaced, contaminated frangible section.

To solve the latter problem, some containers are provided with frangible sections that are separated along a score line from an end wall of the container to form an opening, but instead of being pushed into the container, are folded back externally of the container.

In some constructions, this type of closure remains attached to the container, and in other constructions the closure is completely separated from the container. These types of opening forming means are commonly used on pet food containers, or containers of solid food products, or other materials, and while they solve the problems related to contamination of the contents of the container, they raise the possibility of injury to a person handling the container because of the exposed sharp edge of the separated section. Efforts have been made to solve this problem in some prior art devices by placing folds in the material of the end wall adjacent the severed edge, or by providing a layer of protective material over the severed edge. Such prior art devices are either difficult and expensive to produce, or are not entirely satisfactory in operation.

Accordingly, there is need for a simple and inexpensive closure means for containers, especially of the tear tab variety, which is captive on the container and thereby does not lead to environmental contamination by discarded tabs and removable sections, but which also does not enter the container and potentially contaminate the contents of the container, or expose sharp edges which may injure the user.

SUMMARY OF THE INVENTION

The present invention provides a simple and inexpensive closure means for containers, especially of the tear tab variety, which is captive on the container and thereby does not lead to environmental contamination by discarded tabs and removable sections, but which also does not enter the container and potentially contaminate the contents of the container, or expose sharp edges which may injure the user.

The tear tab closure of the invention is joined to the container end wall along a frangible score line, and a fold is formed in the material of the end wall adjacent the score line to form a barrier or shield to the exposed edge of the closure tab after it is separated along the score line, thereby preventing injury to the user which might otherwise occur because of an exposed, sharpened edge.

In the invention, the score line is formed in the top surface of the container end wall, and is shaped to concentrate and direct fracturing of the material along the score line. By altering the shape of the score line, the tearing force and direction of fracture may be concentrated and/or directed in a desired way.

The tear tab closure and fold of the invention are constructed so that a minimum amount of dirt or other foreign matter will become trapped on or adjacent the closure, thereby maintaining a cleaner environment on and around the closure and associated opening.

To facilitate operation of the tear tab closure of the invention, the protective fold or shield may be indented or weakened at selected locations to promote bending of the tab at such locations during opening of the closure.

A variety of differently configured folds may be employed to form the protective shield for the severed edge of the tear tab, but each fold includes a vertical component extending either above or below, or both above and below, the severed edge on the closure tab. In either event, the fold is constructed so that a minimum amount of foreign matter is capable of being trapped by the folded material, and the fold may be easily made using conventional technology. Further, the fold and score line are related so that the severed edge of the removable section is shielded by the fold, thereby guarding against injury to a person handling the container.

Similarly, a variety of pull tabs may be used to separate the frangible section along the score line and form the opening in the container end wall. A preferred pull tab includes pry bars that extend beyond the score line to facilitate breaking of the score line and lifting of the frangible section, but many constructions may be used, including those conventional in the prior art. The pull tab is attached to the frangible section at a location that is near the perimeter of the container end wall, and near the score line. Consequently, great leverage can be exerted to initiate tearing of the score line; and when fully opened, the pull ring or tab and the frangible section will lie essentially within the space bounded by the container end wall.

BRIEF DESCRIPTION OF THE DRAWINGS

The foregoing, as well as other objects and advantages of the invention will become apparent from the following detailed description when considered in conjunction with the accompanying drawings, in which like reference characters designate like parts throughout the several views, and wherein:

FIG. 1 is an enlarged, fragmentary, top perspective view of a captive tear tab according to the invention, shown in place on a container end;

FIG. 2 is a fragmentary top perspective view, on a reduced scale showing the tear tab of FIG. 1 in a fully opened position;

FIG. 3 is a greatly enlarged, fragmentary top perspective view, with the pull ring removed for purpose of clarity, to show the tear tab structure;

FIG. 4 is a vertical sectional view taken transversely to the long axis of the tear tab, shown on a reduced scale;

FIG. 5 is a greatly enlarged fragmentary sectional view of a portion of the tear tab and container end wall, showing the relationship of the fold and score line to the end wall and tear tab;

FIG. 8 is a somewhat schematic transverse sectional view of the container end of FIG. 1, showing the relationship of the parts in their normal, sealed position;

FIG. 9 is a somewhat schematic transverse sectional view showing the relative positions of the pull ring and tear tab at the point at which fracturing of the material along the score line is initiated;

FIG. 10 is a somewhat schematic sectional view of the closure of the invention as it appears at the end of the initial opening movement for initiating fracturing of the score line;

FIG. 11 is a somewhat schematic sectional view of the closure of the invention as it appears during initial rearward movement to pull the tear tab from the container end;

DETAILED DESCRIPTION OF THE PREFERRED EMBODIMENTS

Figure 6:
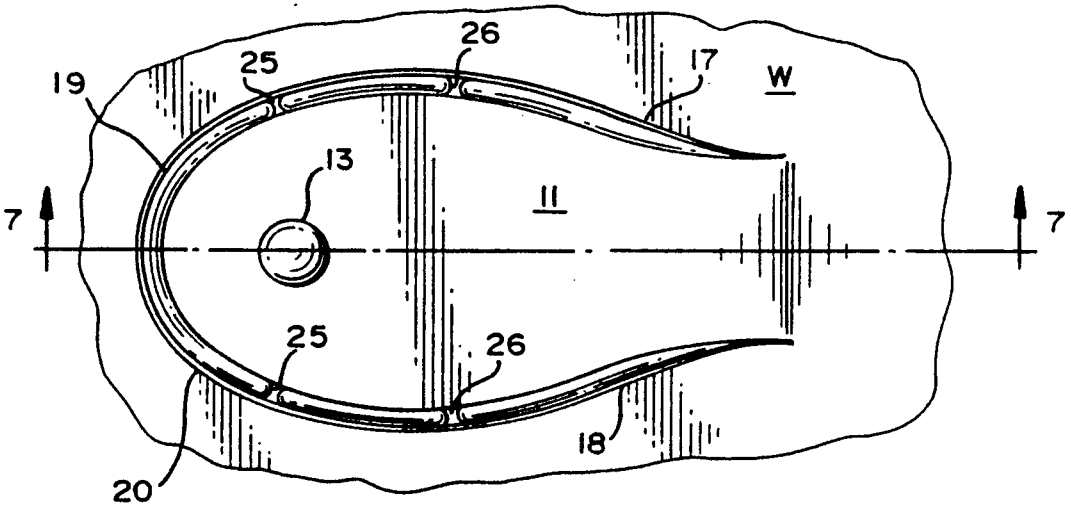
FIG. 6 is a greatly enlarged fragmentary bottom plan view of the tear tab structure of FIG. 1.

With particular reference to the drawings, a first form of tear tab closure in accordance with the invention is indicated generally at 10 in FIGS. 1–13.

The closure 10 comprises a tear tab 11 formed integrally with the container end wall W, and a pull ring 12 joined to the tear tab ii via a rivet 13.

As seen best in FIGS. 3, 6 and 7, the tear tab is defined by a portion of the container end wall material deformed to provide a vertical fold 14 having a depending bight portion 15 projecting below the plane of the wall W, and an upwardly extending wall 16 projecting above the plane of the end wall W. This vertical fold extends substantially continuously along the opposite sides 17 and 18 and one end 19 of the tear tab. The other end or the right-hand end of the tear tab, as viewed in FIGS. 6 and 7, lies in the plane of the end wall W and is a continuation thereof.

A frangible score line 20 extends around the opposite sides 17 and 18 and the end 19 of the tear tab in close proximity to the fold 14. This score line 20 is formed in the upper surface of the container end wall and is positioned such that when the tear tab is separated from the wall W, the severed edge lies between the top and bottom edges of the fold 14. Thus, the fold protects or shields the user from the exposed edge of the tear tab after it has been separated along the score line. Moreover, placement of the score line on the top surface of the container wall facilitates initial fracturing thereof upon initial pivoting movement of the pull ring about the rivet 13.

Additionally, and as seen best in FIGS. 6–12, the fold 14, and specifically the depending bight portion 15, may be indented at a plurality of locations 25 and 26 to render those particular locations relatively weak with respect to the remainder of the fold and thereby define hinge lines to facilitate bending of the tear tab during its opening movement. Thus, with reference to FIGS. 9 and 10, the indentations 25 near the forward end of the tear tab define a hinge line about which the tear tab initially flexes when the pull ring 12 is initially lifted. This results in the nose of the tear tab flexing downwardly, breaking the score line 20 and enabling the tear tab and pull ring to begin lifting upwardly, fracturing the score line.

The second set of indentations 26 define a second hinge line spaced rearwardly of the first hinge line to facilitate upward bending of the tear tab during rearward movement of the pull ring, and thereby facilitating tearing of the score line.

Initial fracturing of the score line and upward pulling of the tear tab are facilitated by the construction of the pull ring 12, as seen best in FIG. 1. In this figure, it can be seen that the pull ring includes a pair of forwardly projecting pry-bar legs 12A and 12B extending beyond the fold and score line to rest on the surface of the end wall W A relatively small nose section 12C on the pull ring is positioned to press downwardly on top of the tear tab immediately adjacent the fold and score line to concentrate force and initiate fracturing of the score line at the end of the tear tab. Further in this connection, the rivet 13 is located relatively near the forward end or portion of the tear tab that is initially separated from the container end wall, whereby maximum leverage is obtained. The fold not only defines a shield for protecting the user from any sharpened portions of the severed edge of the tear tab, but also defines a reinforced structure at the perimeter of the tear tab, facilitating its separation from the container end wall along the score line.

Additionally, the fold and tear tab are constructed such that the retention or accumulation of foreign material on the tear tab and/or container end is minimized, thereby minimizing the risk of contamination of the contents of the container upon opening of the tear tab. In other words, the tear tab of the invention does not include any recessed structure which would tend to trap such foreign matter. Instead, the container end wall and tear tab define relatively flat, smooth structures for reducing any tendency to trap foreign material. In this connection, the folds are shown in somewhat exaggerated form in the drawings, but it should be understood that the bight portion 15 is essentially closed, with the material of the two vertical parts of the bight portion being disposed in contact with one another whereby foreign material cannot be trapped between the two vertical portions.

In one specific example of a tear tab closure constructed in accordance with the invention, the bight portion 15 of the vertical fold 14 extends downwardly below the plane of the end wall W a distance of from about 1/32 of an inch to about ¼ of an inch, and the upwardly extending wall portion 16 similarly extends above the plane of the end wall W a distance of from about 1/32 of an inch to about ¼ of an inch. Further, the pry-bar legs 12A and 12B may have a length of from about 1/8 of an inch to about ¼ of an inch.

Figure 7:
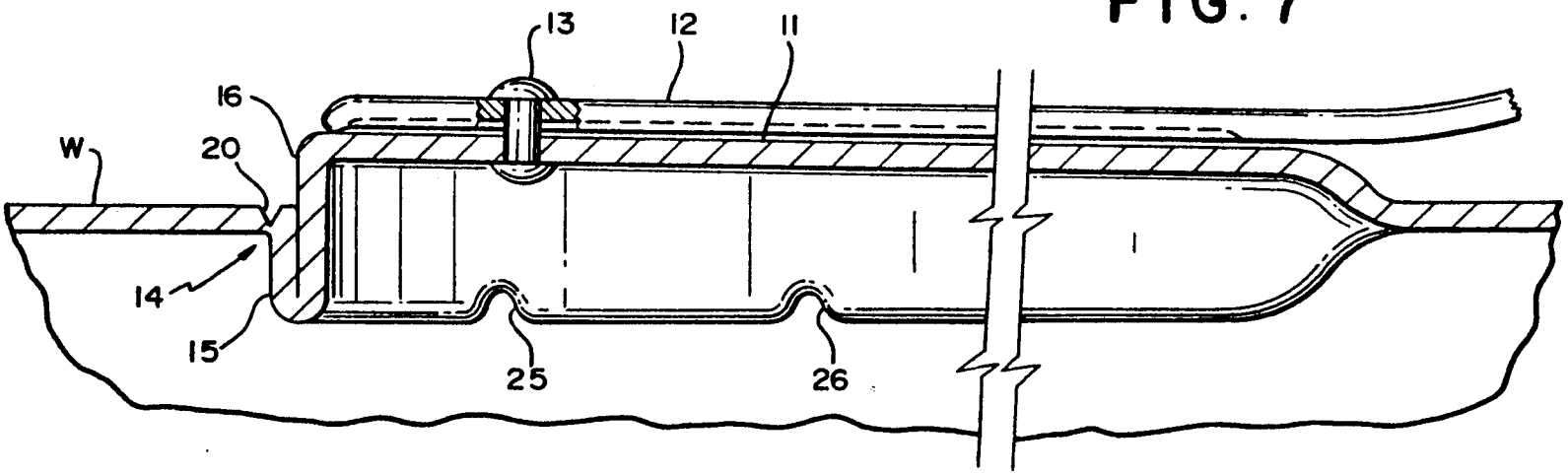
FIG. 7 is a view in section taken along 7—7 in FIG. 5.
Figure 12:
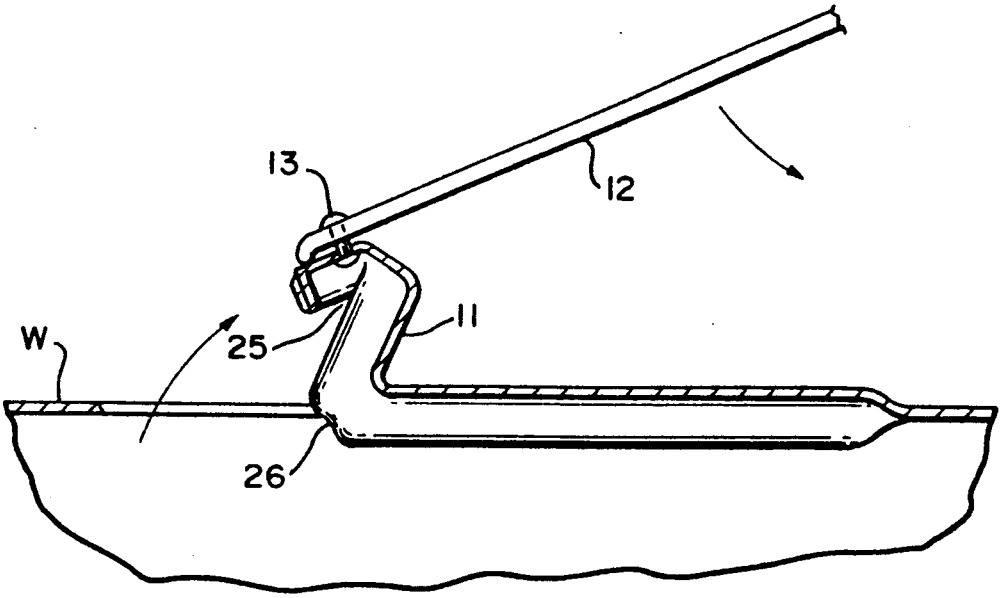
FIG. 12 is a somewhat schematic sectional view showing the tear tab and pull ring in an intermediate position during the opening movement.
Figure 13:
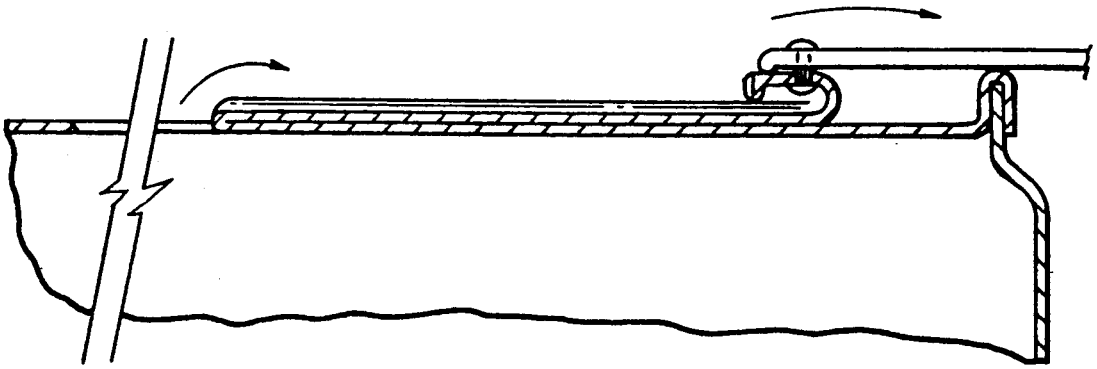
FIG. 13 is a somewhat schematic sectional view of the tear tab and pull ring of the invention shown in fully opened position.

As seen in FIGS. 6 and 7, the score line 20 is formed contiguous to the vertical fold, whereby there is no horizontally projecting portion remaining on the tear tab after it is separated from the container end wall W along the score line. This close placement of the score line to the vertical walls, and the shielding effect provided by the vertical fold, virtually eliminates the chance of inflicting a cut on the hand of the user by the severed edge of the tear tab.

Figure 17:
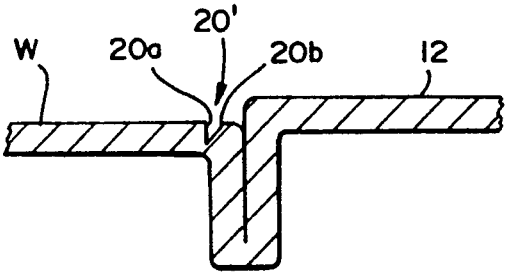
FIGS. 17–19 are enlarged, fragmentary sectional views of portions of a container end wall and associated tear tab, showing variations of the shape and direction of the score line.
Figure 18:
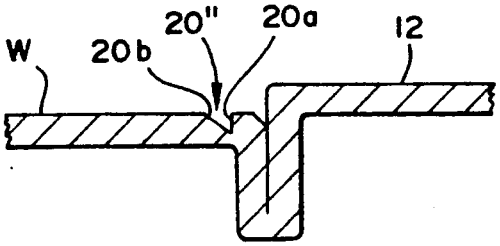
Figure 19:
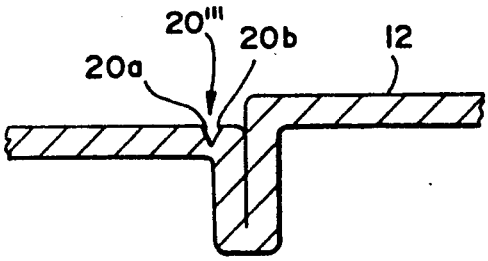

Moreover, as seen in FIGS. 17, 18 and 19, the score line 20' may have a V-shape in transverse cross section, with a vertical wall **20*a* on the side of the "V" spaced from the fold 14 and a sloping wall 20*b* on the side of the "V" adjacent the fold. Alternatively, the vertical wall 20*a* may be located adjacent the fold and the sloping wall 20*b* remote, as shown at 20'' in FIG. 18; or, the "V" 20''' could be symmetrically formed, with both walls 20*a* and 20*b*** sloping equally. In each case, the score line extends approximately one-half the depth of the end wall, and the particular orientation of the "V" is selected dependent upon a desired operating characteristic.

While only two areas of indentation 25 and 26 have been shown in the vertical fold 14 for defining hinge lines, it should be noted that one or any number of indentations and resulting hinge lines may be provided, as desired.

Figure 14:
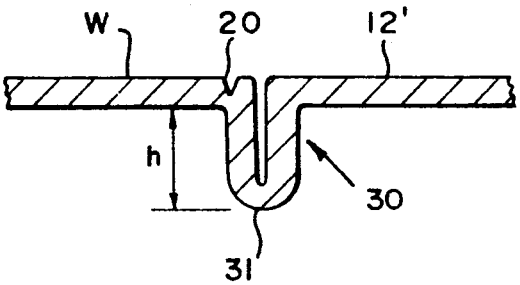
FIG. 14 is a greatly enlarged transverse sectional view of a first modification of the tear tab according to the invention.

Variations of the protective vertical fold are shown in FIGS. 14–17. The simplest construction is shown in FIG. 14, wherein the vertical fold 30 comprises a bight portion 31 projecting below the end wall W of the container a distance or height h. There is no upwardly projecting vertical wall corresponding to wall 16 in the previously described form of the invention, and the tear tab 12' lies in the same plane as the plane of the end wall W.

Figure 15:
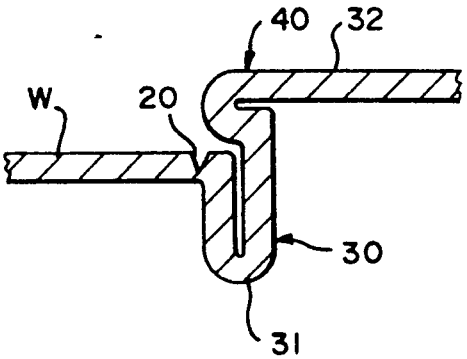
FIG. 15 is a view similar to FIG. 14 of a second modification of the tear tab of the invention.

FIG. 15 shows a similar construction, except a horizontal fold 40 is formed in an edge portion of the tear tab 32 and replaces the vertically projecting wall 16 of the previously described form of the invention. This horizontal fold 40 projects outwardly over the bight portion 31 of the downwardly projecting vertical fold 30 and extends into close proximity with the score line 20. In this connection, the score line 20 is spaced a slight distance horizontally from the vertical fold 30, and the horizontal fold 40 provides a shield or protective structure for the severed edge that remains when the tear tab is removed from the end wall along the score line 20.

Figure 16:
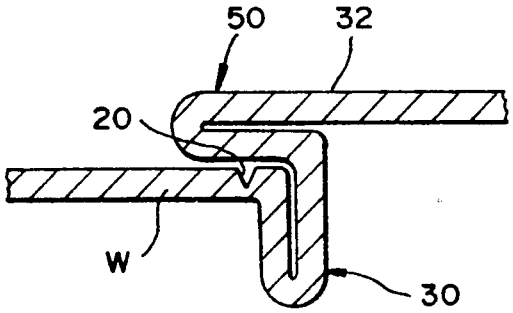
FIG. 16 is a view similar to FIG. 15 of a third modification of the tear tab of the invention.

A similar construction is shown in FIG. 16, and is identical with the structure shown in FIG. 15, except that the horizontal fold 50 projects laterally outwardly in overlying relationship to the score line 20.

Figure 20:
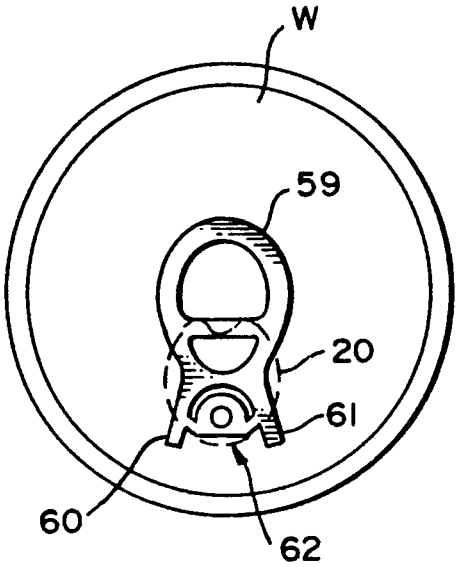
FIGS. 20–27 are somewhat schematic top plan views of various pull ring configurations which may be used with the various tear tab structures of the invention.
Figure 21:
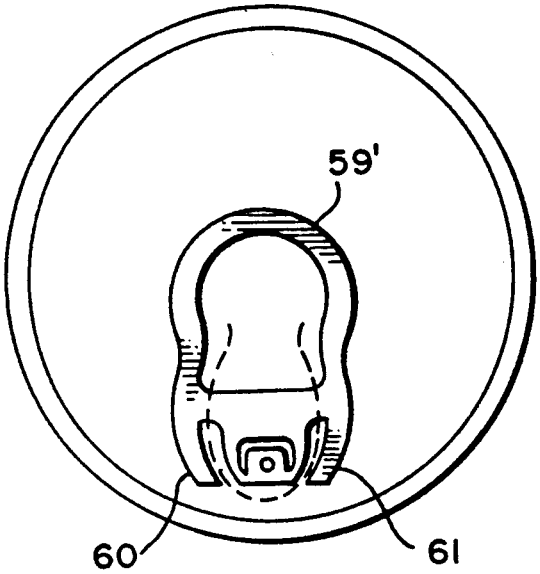
Figure 22:
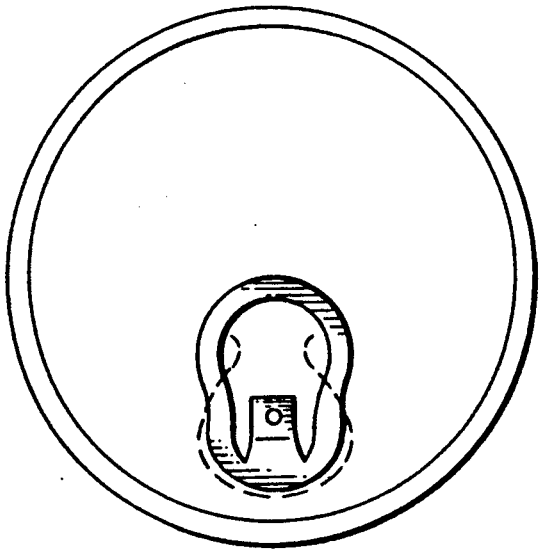
Figure 23:
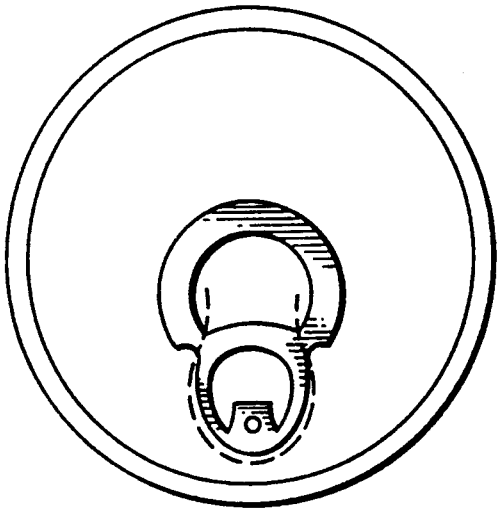
Figure 24:
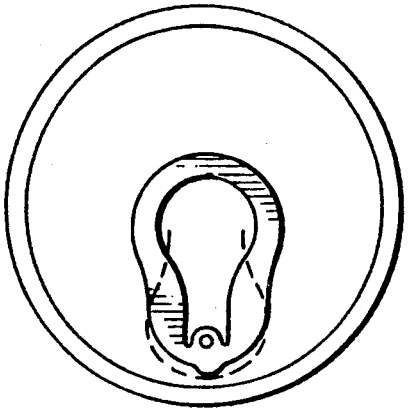
Figure 25:
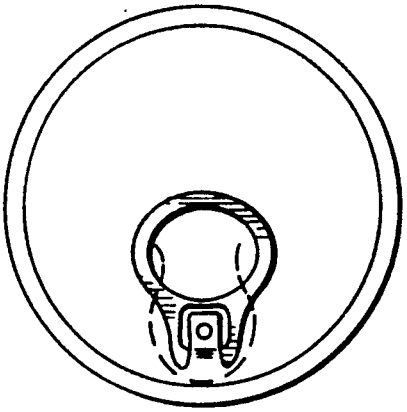
Figure 26:
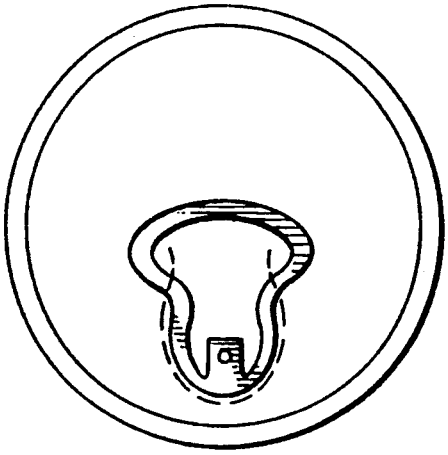
Figure 27:
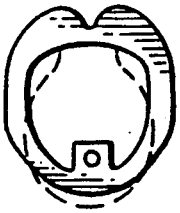

A variety of pull ring structures are shown in FIGS. 20–27. FIGS. 20 and 21 are noteworthy because of the prybar legs 60 and 61 formed on the respective pull rings 59 and 59' and projecting outwardly over the score line 20 to rest on the adjacent portion of the end wall W, whereby when the pull ring 59 or 59' is lifted the prybar legs press downwardly against the end wall and cause the pull ring to exert an upward force on the end portion of the tear tab to cause fracturing of the score line and initiate opening of the tear tab.

The remaining pull rings are of essentially conventional construction and function to open the tear tab in a known manner, subject to the benefits provided by the invention as described previously herein.

The tear tab closure of the invention is captive on the container and does not break away for disposal and potential environmental contamination. Moreover, the tear tab closure of the invention does not enter or project into the container when it is opened, and therefore maintains a more sanitary environment for the contents of the container. Further, the unique construction of the tear tab of the invention makes it safe in use, with the severed edge of the tear tab being shielded from contact with the skin of the user.

While the invention has been shown and described in detail, it is obvious that this invention is not to be considered as being limited to the exact form disclosed, and that changes in detail and construction may be made therein within the scope of the invention, without departing from the spirit thereof.

What is claimed is:

1. In a container closure of the type having a tear tab formed integrally in a container end wall and joined to the container end wall along a frangible score line, with a pull ring attached to the tear tab for separating it from the end wall along the score line to form an opening in the end wall, and wherein the tear tab is permanently joined to the container end wall at one end of the tear tab, and is operated by the pull ring so as to be pulled back from the plane of the end wall and thus not project into the container when opened, the improvement comprising:

a vertical fold formed in the material of the tear tab along the peripheral edge thereof adjacent the score line and defining at least a downwardly extending bight portion projecting below the plane of the container end wall to form a shield protecting a user from the severed edge of the tear tab when it is separated from the end wall along the score line, said tear tab and container end wall defining substantially smooth, planar surfaces free of recesses which might trap foreign matter.

2. A closure as claimed in claim 1, wherein: said bight portion of the vertical fold is indented to define a hinge line for facilitating bending movement of the tear tab during opening movement thereof.

3. A closure as claimed in claim 1, wherein:

said vertical fold includes a vertical wall projecting upwardly from the bight portion to above the plane of the container end wall, said tear tab lying in a plane at the upper end of the upwardly projecting vertical wall.

4. A closure as claimed in claim 1, wherein:

said bight portion includes a vertical wall extending downwardly from the container end wall, and a contiguous upwardly extending vertical wall projecting slightly above the plane of the container end wall and terminating in a horizontal fold defining a horizontally oriented bight portion that extends into close proximity with the score line, and said tear tab extends in coplanar relationship with the top of said horizontally oriented bight portion.

5. A closure as claimed in claim 3, wherein:

said bight portion of the vertical fold is indented to define a hinge line for facilitating bending movement of the tear tab during opening movement thereof.

6. A closure as claimed in claim 4, wherein:

said bight portion of the vertical fold is indented to define a hinge line for facilitating bending movement of the tear tab during opening movement thereof.

7. A closure as claimed in claim 4, wherein: said horizontally oriented bight portion projects horizontally outwardly from the tear tab and into overlying relationship to the score line.

8. A closure as claimed in claim 1, wherein:

the bight portion includes a first vertical wall extending downwardly from the container end wall, and a second vertical wall projecting upwardly therefrom in contiguous relationship thereto, with the upper end of the second vertical wall being coterminous with the plane of the container end wall, whereby the tear tab lies in the same plane as the container end wall.

9. A closure as claimed in claim 1, wherein:

the vertical fold has a dimension perpendicular to the plane of the container end wall of from about 1/32 of an inch to about ¼ of an inch.

10. A closure as claimed in claim 1, wherein:

the vertical fold includes vertical wall portions projecting both above and below the plane of the container end wall respective distances of from about 1/32 of an inch to about ¼ of an inch, and the score line is positioned approximately midway the height of the vertical fold.

11. A closure as claimed in claim 1, wherein:

said score line is V-shaped in transverse cross-section, and is formed contiguous to the vertical fold so that there is no projecting severed edge on the tear tab after it is separated from the container end wall along the score line.

12. A closure as claimed in claim 11, wherein:

said score line extends substantially one-half the depth or thickness of the container end wall.

13. A closure as claimed in claim 12, wherein:

the V-shaped score line is symmetrically formed, having opposed side walls incldined equally outwardly from a line vertical to the plane of the end wall and extending through the apex or point of the V-shaped score line.

14. A closure as claimed in claim 12, wherein:

the V-shaped score line has opposed side walls, one of said side walls being incldined toward the tear tab and the other of said side walls extending vertically to the plane of the container end wall.

15. A closure as claimed in claim 12, wherein:

the V-shaped score line has opposed side walls, one of said side walls being inclined away from the tear tab and the other of said side walls extending vertically to the plane of the container end wall.

* * * * *